US010183512B2

(12) United States Patent
Iwaya et al.

(10) Patent No.: US 10,183,512 B2
(45) Date of Patent: Jan. 22, 2019

(54) RECORDING APPARATUS

(71) Applicant: SEIKO EPSON CORPORATION, Tokyo (JP)

(72) Inventors: Satoshi Iwaya, Ina (JP); Yoshisada Aoki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/506,683

(22) PCT Filed: Aug. 21, 2015

(86) PCT No.: PCT/JP2015/004211

§ 371 (c)(1),
(2) Date: Feb. 24, 2017

(87) PCT Pub. No.: WO2016/031215

PCT Pub. Date: Mar. 3, 2016

(65) Prior Publication Data

US 2017/0253060 A1 Sep. 7, 2017

(30) Foreign Application Priority Data

Aug. 29, 2014 (JP) ..... 2014-175119

(51) Int. Cl.

| | |
|---|---|
| ***B41J 29/02*** | (2006.01) |
| ***B41J 29/12*** | (2006.01) |
| ***B41J 29/13*** | (2006.01) |
| ***B41J 2/175*** | (2006.01) |

(52) U.S. Cl.

CPC ..... *B41J 29/13* (2013.01); *B41J 2/1752* (2013.01); *B41J 2/17509* (2013.01); *B41J 2/17553* (2013.01); *B41J 29/02* (2013.01)

(58) Field of Classification Search

CPC ..... B41J 29/02; B41J 29/12; B41J 29/13
See application file for complete search history.

(56) References Cited

U.S. PATENT DOCUMENTS

| | | | | |
|---|---|---|---|---|
| 7,008,051 | B2 | 3/2006 | Akermalm | |
| 2004/0125182 | A1* | 7/2004 | Akermalm | B41J 2/17509 347/85 |
| 2012/0206552 | A1* | 8/2012 | Uchino | B41J 29/13 347/108 |

FOREIGN PATENT DOCUMENTS

| | | |
|---|---|---|
| JP | 2007-106019 | 4/2007 |
| JP | 2009-202346 | 9/2009 |
| JP | 2012-061620 | 3/2012 |

(Continued)

OTHER PUBLICATIONS

Shimizu et al., MachineTranslationofJP 2012061620 A, 2012.*

(Continued)

*Primary Examiner* — Geoffrey S Mruk
*Assistant Examiner* — Scott A Richmond
(74) *Attorney, Agent, or Firm* — Workman Nydegger

(57) ABSTRACT

Disclosed is a recording apparatus including a frame, a recording head that is disposed in the frame, and performs recording by ejecting a liquid onto a recording medium, a stay that is disposed with the frame, and supports a liquid accommodation body, which accommodates a liquid to be ejected from the recording head, outside the frame, an ink supply tube that supplies a liquid that is accommodated in the liquid accommodation body, which is supported by the stay, to the recording head, and a frame cover that is detachable from the frame.

10 Claims, 11 Drawing Sheets

(56) References Cited

FOREIGN PATENT DOCUMENTS

| | | | |
|---|---|---|---|
| JP | 2012061620 A | * | 3/2012 |
| JP | 2012-071585 | | 4/2012 |
| JP | 2012-152996 | | 8/2012 |

OTHER PUBLICATIONS

International Search Report and Written Opinion dated Oct. 13, 2015, issued in PCT Application No. PCT/JP2015/004211, filed Aug. 21, 2015.

* cited by examiner

RECORDING APPARATUS

The entire disclosure of Japanese Patent Application No. 2014-175119, filed Aug. 29, 2014 is expressly incorporated by reference herein.

TECHNICAL FIELD

The present invention relates to a recording apparatus that performs recording by ejecting a liquid from a recording portion.

BACKGROUND ART

In a recording apparatus that is set forth in PTL 1, a configuration in which an accommodation case, which accommodates an ink bag (a liquid accommodation body), is mounted on a cover of a main body apparatus that includes a recording portion, which ejects an ink (a liquid), is disclosed. In the recording apparatus, printing (recording) is performed by supplying the ink that is accommodated in the ink bag to the recording portion inside the main body apparatus via an ink supply tube, and ejecting the supplied ink onto a medium such as sheets of paper from the recording portion.

CITATION LIST

Patent Literature

PTL 1: U.S. Pat. No. 7,008,051

SUMMARY OF INVENTION

Technical Problem

Incidentally, in the above-mentioned recording apparatus, it is necessary to disengage the cover when performing maintenance inside the main body apparatus.

Since the ink supply tube is linked to an inner portion of the main body apparatus from the liquid accommodation body, which is provided in an outer portion of the main body apparatus, in a case in which the accommodation case and the cover have an integral configuration in the manner of PTL 1, the ink supply tube also comes away when the cover is disengaged from the main body apparatus, and therefore, a load is applied to the ink supply tube. Therefore, there is a concern that the ink supply tube will come loose and that the ink will leak out.

In addition, it is possible to consider disengaging the cover from the main body apparatus after separating the accommodation case from the main body apparatus, but in such a case, since the accommodation case is an ink bag type that is heavy due to accommodating a high capacity of ink, the workability of the operation of separating the accommodation case from the main body apparatus is poor, and therefore, the load of the maintenance is increased.

Additionally, this problem is not limited to recording apparatuses that eject ink from recording heads, and is generally common to recording apparatuses that supply a liquid to a recording head from a liquid accommodation body, in which a liquid to be ejected from the recording head is accommodated, via a liquid supply tube.

The present invention was devised in the light of the above-mentioned technical problem, and an object thereof is to provide a recording apparatus in which maintenance can be performed easily.

Solution to Problem

In order to solve the above-mentioned technical problem, a recording apparatus includes a frame, a recording portion that is disposed in the frame, and performs recording by ejecting a liquid onto a recording medium, a support unit that is disposed in the frame, and supports a liquid accommodation body, which accommodates a liquid to be ejected from the recording portion, outside the frame, a liquid supply tube that supplies a liquid that is accommodated in the liquid accommodation body, which is supported by the support unit, to the recording portion, and a frame cover that is detachable from the frame.

In this case, since the support unit is fixed to the frame in place of the frame cover, when the frame cover is disengaged from the frame, it is possible to disengage the frame cover in a manner in which the liquid accommodation body, which is supported by the support unit, the support unit, and furthermore, the liquid supply tube, and the like, which are linked to the liquid accommodation body and the frame inner portion, are still in states of being fixed to the frame. Therefore, when the frame cover is disengaged from the frame, circumstances in which the weight thereof is excessive, or in which a load is applied to the liquid supply tube, are suppressed, and therefore, it is possible to easily disengage the frame cover. Accordingly, it is possible to easily perform maintenance of the recording apparatus.

In addition, in the recording apparatus, it is desirable that the frame cover cover the liquid accommodation body, which is supported by the support unit.

In this case, it is possible to protect the liquid accommodation body using the frame cover.

In addition, according to an aspect of the recording apparatus, the support unit includes a support unit cover, which covers a lower portion of the liquid accommodation body, which is supported by the support unit, and the frame cover covers an upper portion of the liquid accommodation body, which is supported by the support unit.

In this case, it is possible to protect the liquid accommodation body, which is supported by a support mechanism, as a result of covering using the support unit cover and the frame cover.

In addition, in the recording apparatus, it is desirable that the frame cover be provided with a lid body that opens and closes an opening, through which the liquid accommodation body is retrieved.

In this case, since the frame cover is provided with a lid body, it is possible to also disengage the lid body when disengaging the frame cover from the frame. Therefore, when maintenance of the frame inner portion is performed by exposing the support unit, it is possible to perform the maintenance in conjunction with the maintenance of the support unit, the liquid supply tube, and the like. Accordingly, it is possible to more easily perform maintenance of the recording apparatus.

In addition, according to an aspect of the recording apparatus, the support unit includes an accommodation case, which accommodates the liquid accommodation body, which is supported by the support unit, and the frame cover is separate from the accommodation case.

In this case, it is possible to protect the liquid accommodation body, which is supported by the support mechanism, as a result of accommodation in the accommodation case. In addition, since the accommodation case and the frame cover are provided separately, when the frame cover is disengaged from the frame, it is possible to disengage the frame cover in a manner in which the accommodation case is still in a state of being fixed to the frame. Accordingly, it is possible to easily perform maintenance of the recording apparatus.

In addition, in the recording apparatus, the recording portion may include a recording head, which ejects a liquid onto a recording medium, and a carriage, in which the recording head is mounted, and which reciprocates, the frame may include a guide frame, which guides the carriage, and a retention frame, which retains end portions of the guide frame in a direction in which the carriage reciprocates, and the support unit may be fixed to the retention frame.

In addition, in the recording apparatus, it is desirable that the support unit include a partitioning wall, which partitions the liquid accommodation body, which is supported by the support unit, and the frame, and that the partitioning wall include a communication hole, which exposes the frame.

In this case, when maintenance of the recording apparatus is performed, it is possible to check the frame from the communication hole of the partitioning wall of the support unit, to access parts that are attached to the frame, and the like. Therefore, it is possible to still more easily perform maintenance of the recording apparatus.

DESCRIPTION OF EMBODIMENTS (First Embodiment)

Hereinafter, a first embodiment of a recording apparatus will be described with reference to FIGS. 1 to 9. Additionally, in the present embodiment, an example in which a recording apparatus is embodied as an ink jet type printer (hereinafter, simply referred to as a "printer"), is shown.

Figure 1:
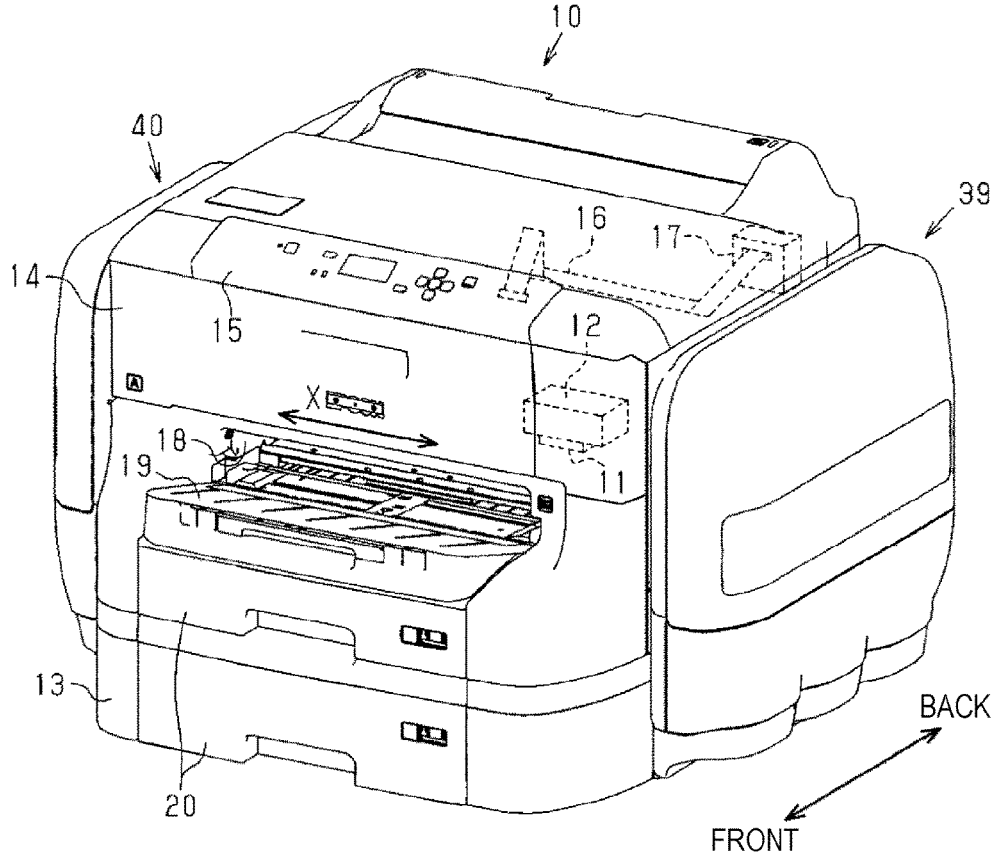
FIG. 1 is a perspective view that shows a recording apparatus as a first embodiment.

As shown in FIG. 1, the printer is provided with a main body apparatus 10, which performs recording on sheets of paper, which are an example of a recording medium, by ejecting an ink, which is an example of a liquid, and two accommodation units 39 and 40, which supply the ink to the main body apparatus 10.

The main body apparatus 10 includes a frame 13, in which a recording head 11 that performs recording on sheets of paper by ejecting the ink, and a carriage 12 that supports the recording head 11, are provided. Additionally, a recording portion is configured by the recording head 11 and the carriage 12. A main body cover 14 is attached to the frame 13 in a detachable manner.

The carriage 12 is capable of reciprocating in an inner portion of the main body apparatus 10 in a scanning direction X, which is a width direction of the printer, and the recording head 11 performs recording (printing) on sheets of paper by ejecting the ink while reciprocating in the width direction of the printer in accordance with movement of the carriage 12.

In addition, an operation panel 15 for a user to operate the printer, is provided in the main body apparatus 10 on an upper surface of the main body cover 14. One end of a flexible flat cable 16 is connected to the operation panel 15. The other end of the flexible flat cable 16 is connected to a control circuit board 17, which is provided in the frame 13. The control circuit board 17 executes various controls on the basis of signals, and the like, from the operation panel 15, which are transmitted via the flexible flat cable 16. Hereinafter, a direction in which the inscriptions of a monitor, buttons, and the like, of the operation panel 15, are direct toward, will be referred to as the front of the printer, and a direction that is opposite to the front will be referred to as the back of the printer.

A rectangular discharge aperture 18, through which sheets of paper on which recording is performed in the inner portion of the main body apparatus 10, are discharged to an outer portion of the main body apparatus 10, is provided in the main body apparatus 10 on a front surface, which is positioned on the front side of the printer. Sheets of paper that are discharged from the discharge aperture 18 are mounted on a discharge tray 19. In addition, upper and lower two-stage paper supply cassettes 20 are mounted in a detachable manner below the discharge tray 19 on the front surface of the main body apparatus 10. It is possible for a plurality of sheets of paper to be accommodated in the paper supply cassettes 20 in a stacked state.

Next, a liquid accommodation body 30, which is accommodated in the accommodation units 39 and 40, will be described with reference to FIG. 2.

Figure 2:
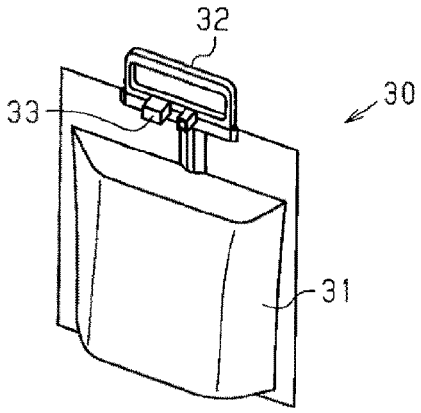
FIG. 2 is a perspective view that schematically shows a liquid accommodation body that is used in the recording apparatus.

As shown in FIG. 2, the liquid accommodation body 30 includes an ink bag 31, which is formed from a flexible material, and the ink is accommodated in the corresponding ink bag 31. An annular rectangular handle portion 32 is fixed to an upper end portion of the ink bag 31. An IC chip 33 is provided in a connection portion of the ink bag 31 and the handle portion 32. Information such as a residual amount and a type of ink that is accommodated in the ink bag 31 is stored in the IC chip 33.

Figure 3:
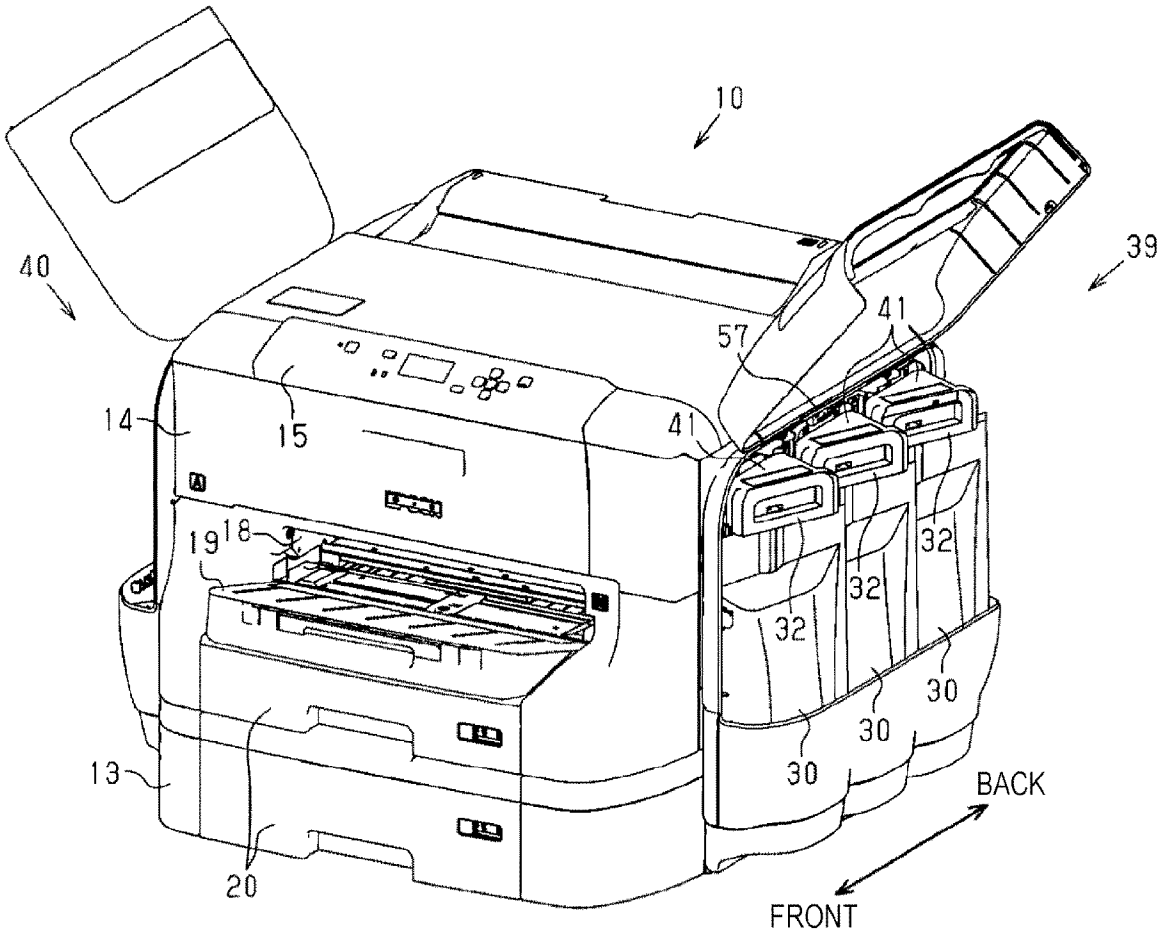
FIG. 3 is a perspective view that shows the recording apparatus in a state in which a lid body is open.

As shown in FIG. 3, three stays 41 are provided in a first accommodation unit 39, which is provided on a right side surface of the main body apparatus 10. The liquid accommodation bodies 30 are attached in a detachable manner as a result of the handle portions 32 of the liquid accommodation bodies 30 being inserted onto each stay 41, and as a result of this, the liquid accommodation bodies 30 are supported on an outer side of the main body apparatus 10. Additionally, yellow ink, magenta ink, and cyan ink are accommodated in the liquid accommodation bodies 30 in order from a front side in a depth direction of the printer, for example.

In addition, a single stay 41 is provided in the second accommodation unit 40, which is provided on a left side surface of the main body apparatus 10. In the same manner as the first accommodation unit 39, the liquid accommodation body 30 is attached in a detachable manner as a result of the handle portion 32 of the liquid accommodation body 30 being inserted onto the stay 41 of the second accommodation unit 40, and as a result of this, the liquid accommodation body 30 is supported on an outer side of the main body apparatus 10. Additionally, for example, the liquid accommodation body 30 that is accommodated in the second accommodation unit 40 accommodates black ink, and the capacity thereof is greater than that of each liquid accommodation body 30 that is provided in the first accommodation unit 39.

Next, a configuration of the frame 13 of the main body apparatus 10 will be described in detail with reference to FIGS. 4 to 6.

Figure 4:
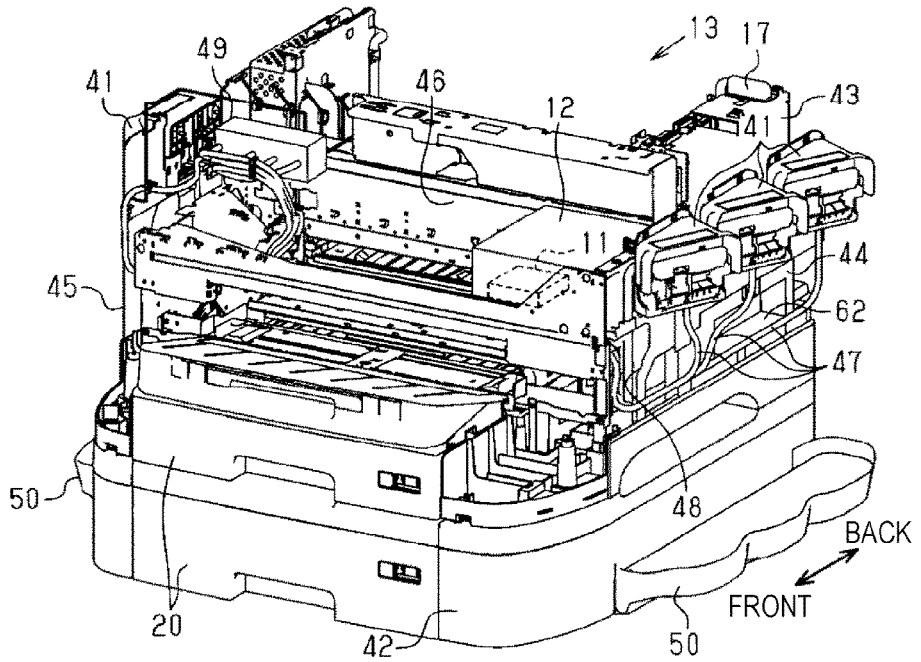
FIG. 4 is a perspective view that shows a frame of a main body apparatus.

As shown in FIG. 4, a resin frame 42, in which the paper supply cassettes 20 are accommodated, is provided in the frame 13. A metal frame 43 is fixed above the resin frame 42. An end portion of a guide frame 46, which transects the frame 13, is fixed to a right side wall 44 and a left side wall 45 of the metal frame 43. The carriage 12, which supports the recording head 11, is supported by the guide frame 46 in a slidable manner. Additionally, the carriage 12 is guided by the guide frame 46, and reciprocates in the scanning direction X. That is, the metal frame 43 functions as a retention frame that retains the end portions of the guide frame 46 in a reciprocating direction of the carriage 12.

The above-mentioned stays 41 are fixed to both side walls 44 and 45 of the metal frame 43. That is, both side walls that are formed from the metal frame 43 and the resin frame 42 of the frame 13, and the stays 41 function as a support unit that supports the liquid accommodation bodies 30 outside the frame 13. In addition, communication holes 62, which communicate between the inner portion and the outer portion of the frame 13, are provided in both side walls 44 and 45 of the metal frame 43. Ink supply tubes 47 are respectively connected below each stay 41. One end of each ink supply tube 47 is connected to a liquid supply needle that is respectively provided in an inner portion of each stay 41. The tip ends of the liquid supply needles are exposed, and are inserted through the inner portions of the liquid accommodation bodies 30 when the liquid accommodation bodies 30 are attached to each stay 41. As a result of this, the ink supply tubes 47, which are connected to the liquid supply needles, and the liquid accommodation bodies 30, are in communication with one another.

The ink supply tubes 47 are routed to the inner portion of the frame 13 through tube through holes 48 that are provided in the metal frame 43. Further, the ink supply tubes 47, which are routed into the inner portion of the frame 13, are connected to the recording head 11 via a relay 49, which is provided in the frame 13. As a result of this, when the liquid accommodation bodies 30 are attached to the stays 41, the ink that is accommodated in the liquid accommodation bodies 30 is supplied to the recording head 11 inside the main body apparatus 10. Additionally, a buffer chamber, which temporarily accumulates the ink that is supplied to the recording head 11 from the liquid accommodation body 30, is provided in the relay 49. In the relay 49, ink is supplied to the recording head 11 by eliminating air that has been caused to flow together with the ink in the buffer chamber.

In addition, reception portions 50, which protrude to the outer side and extend in a front-back direction, are provided on the resin frame 42 of the frame 13.

Figure 5:
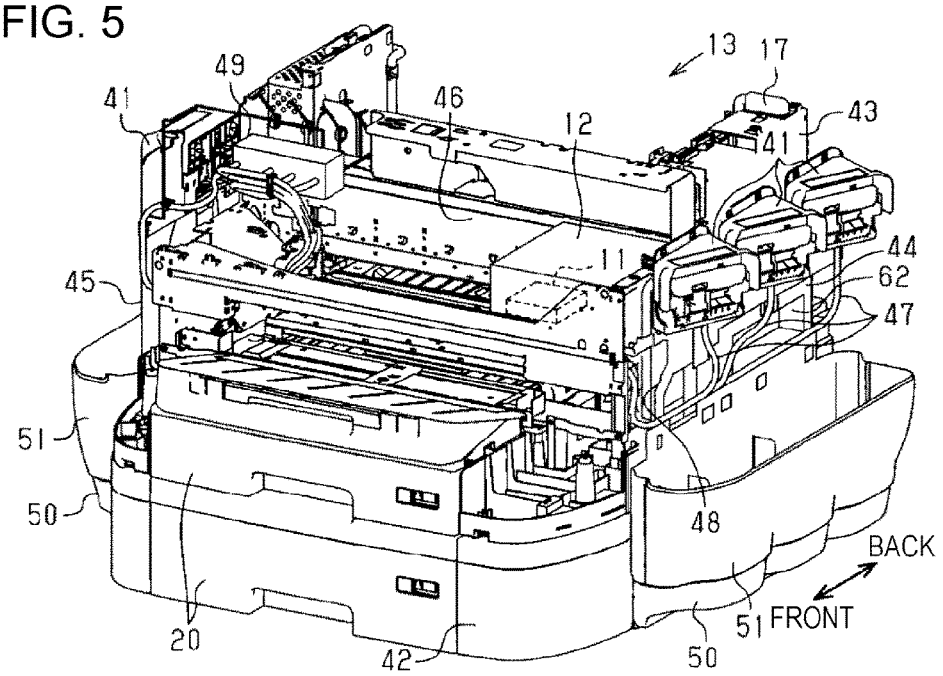
FIG. 5 is a perspective view that shows a state in which a bottom portion is attached to the frame.

As shown in FIG. 5, bottomed box-shaped bottom portions 51 are fixed to both side walls of the frame 13 in a state of being mounted on the reception portions 50. The bottom portions 51 cover a lower portion of the liquid accommodation bodies when the liquid accommodation bodies 30 are attached to the stays 41. That is, the bottom portions 51 function as support unit covers. Additionally, the capacity of the bottom portions 51 is set to be greater than the ink amount that is accommodated in a single liquid accommodation body 30 in a full state. That is, the capacity of the bottom portions 51 is set so that, even in a case in which all of the ink that is accommodated in one of the liquid accommodation bodies 30 leaks out in a state in which three full liquid accommodation bodies 30 are accommodated in the accommodation unit 39, it is possible for all of the leaked ink to amass inside the bottom portions 51.

Figure 6:
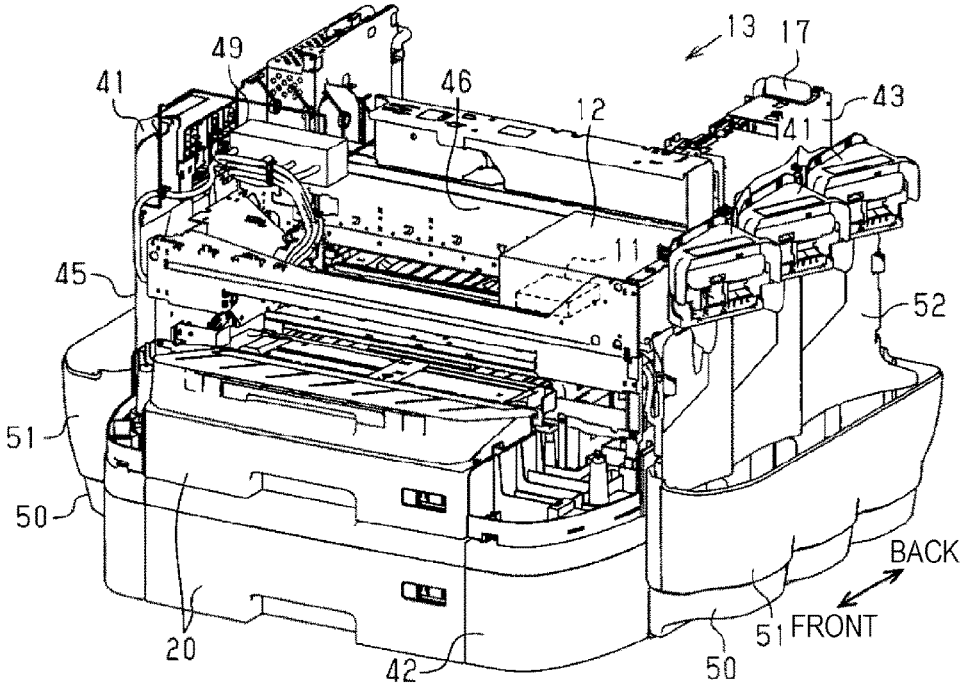
FIG. 6 is a perspective view that shows a state in which a cover is attached to the frame.

In addition, as shown in FIG. 6, covers 52, which conceal the ink supply tubes 47, are attached to the outer surfaces of both side walls of the frame 13. As a result of this, the communication holes 62, which are provided in both side walls of the frame 13, are blocked.

Next, a configuration of the main body cover 14 of the main body apparatus 10 will be described.

Figure 7:
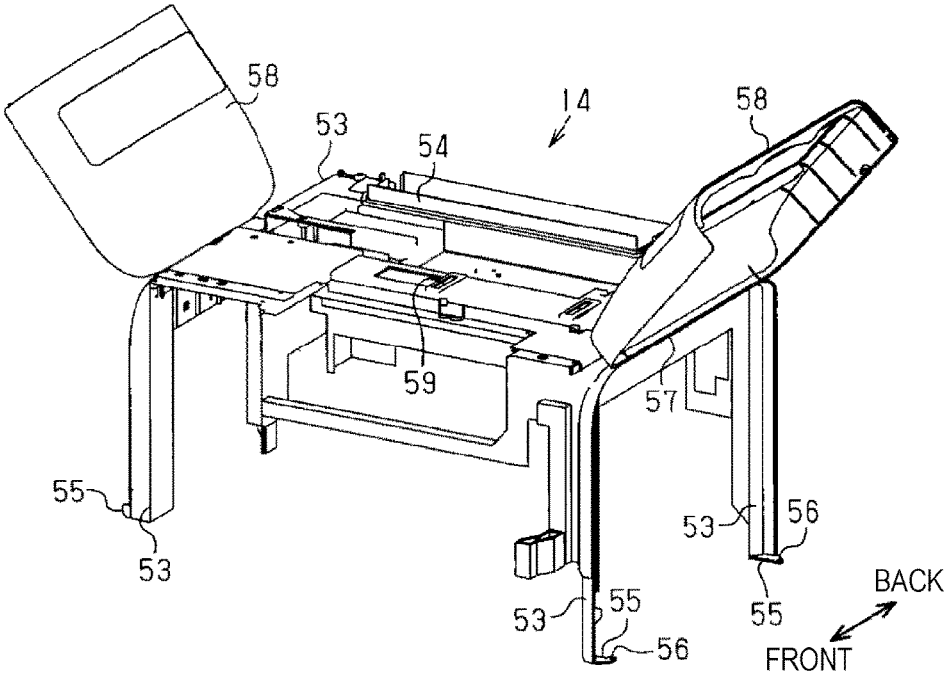
FIG. 7 is a perspective view that shows a frame cover of the main body apparatus.

As shown in FIG. 7, four support columns 53, and a top plate 54, which links each support column 53 are provided in the main body cover 14. Flange portions 55, which extend in directions that are orthogonal to the extension direction of the support columns 53 (the up-down direction in FIG. 7), are provided at the lower ends of the support columns 53. Screw holes 56 are formed in the flange portions 55. Lid bodies 58, which are connected in a revolving manner via hinges 57, are provided on a left end portion and a right end portion of the top plate 54 of the main body cover 14. In addition, a penetration hole 59, through which the flexible flat cable 16 that is connected to the operation panel 15 and the control circuit board 17, is inserted, is provided on the top plate.

Figure 8:
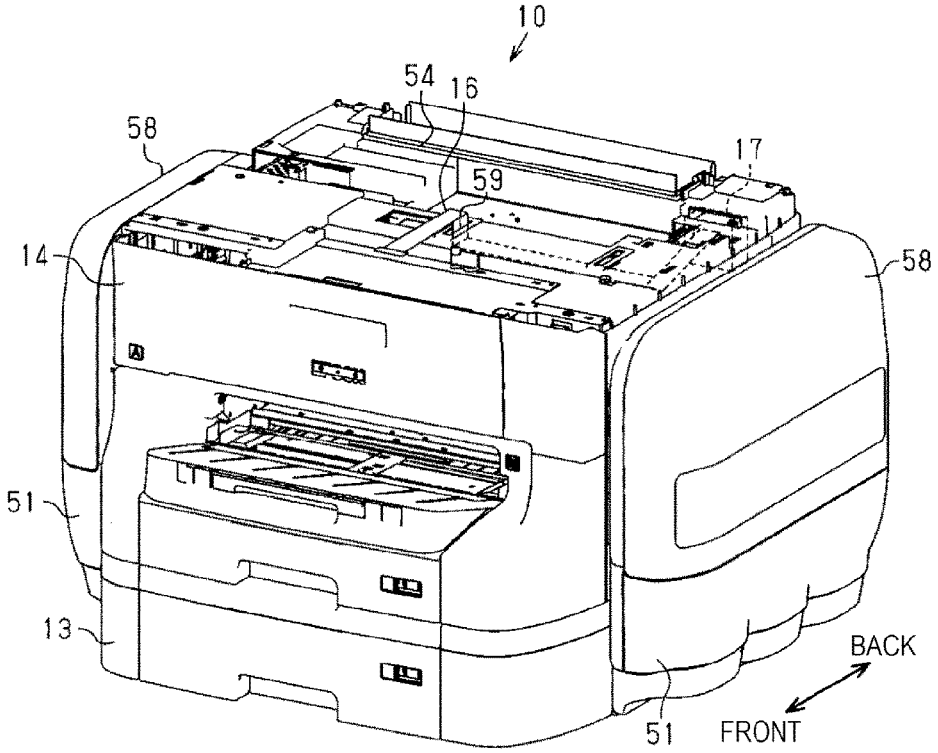
FIG. 8 is a perspective view that shows a state in which the frame cover is attached to the frame.

As shown in FIG. 8, the main body cover 14 is attached from above in a detachable manner to the frame 13. In this state, the support columns 53 of the main body cover 14 are inserted through the bottom portions 51, and the main body cover 14 and the bottom portions 51 are fastened using screws that is inserted through the screw holes 56 of the flange portions 55 of the support columns 53. As a result of this, the main body cover 14 is fixed to the frame 13. Additionally, the operation panel 15 is attached to the upper portion of the main body cover 14, but in FIG. 8, a state in which the operation panel 15 is disengaged is shown. In the present embodiment, a frame cover, which is attached to the frame 13, is configured by the main body cover 14 and the lid bodies 58.

In a state in which the frame cover is attached to the frame 13, the lid bodies 58, which are provided on the frame cover, are connected to the upper ends of the bottom portions 51 in a detachable manner. Therefore, the accommodation units 39 and 40, in which the liquid accommodation bodies 30 that are supported on the stays 41, are accommodated, are configured by both side walls of the frame 13, the bottom portions 51, and the lid bodies 58. Additionally, as shown in FIG. 3, it is possible to open the accommodation units 39 and 40 by revolving the lid bodies 58 with the hinges 57 as the centers thereof, in a manner of becoming separated from the bottom portions 51.

In the printer, when the frame cover is disengaged from the frame 13, as shown in FIG. 8, the operation panel 15 is removed from the main body cover 14, and the screws that fasten the main body cover 14 and the bottom portions 51 are unfastened.

Figure 9:
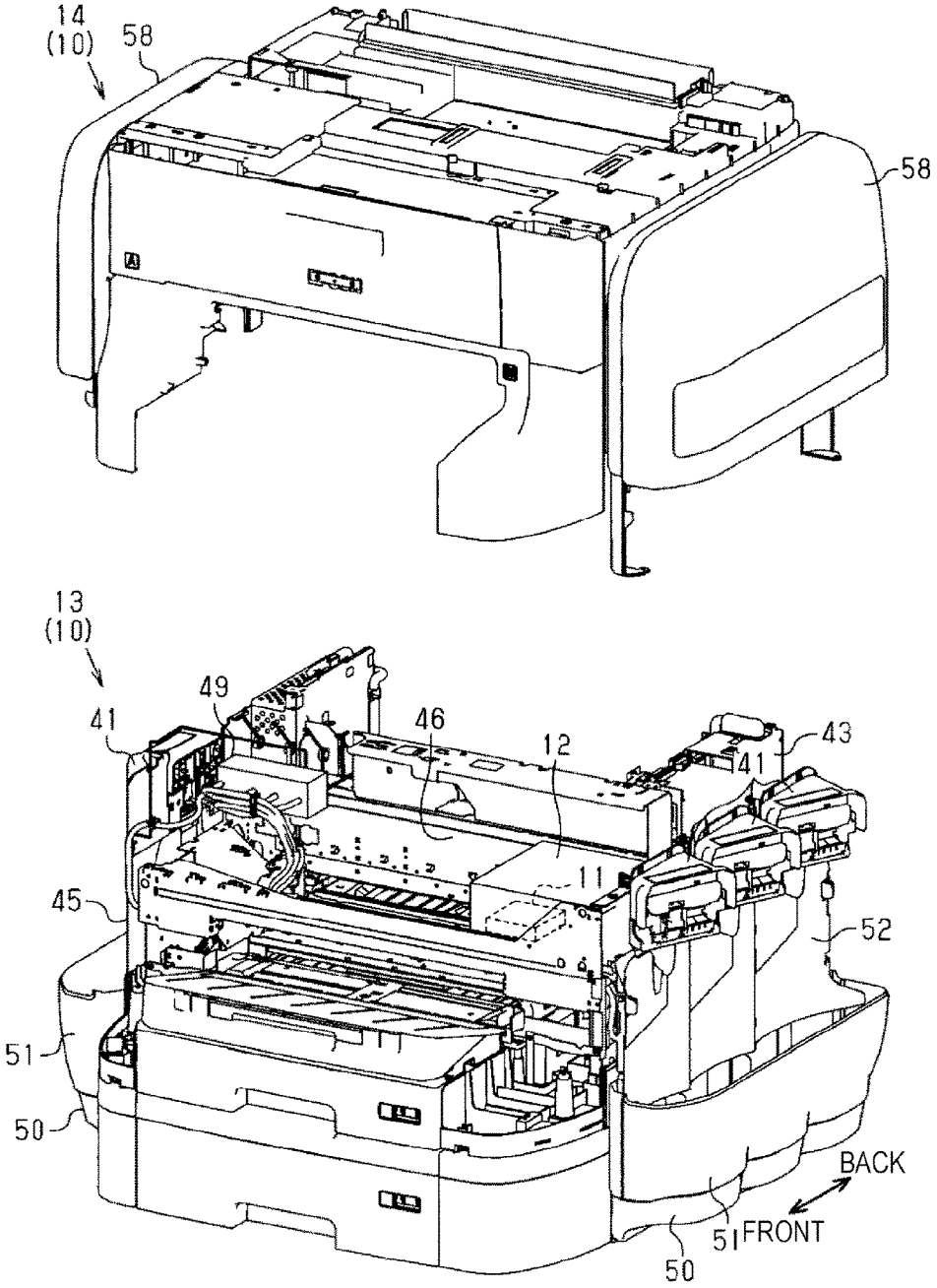
FIG. 9 is a perspective view that shows a state in which the frame cover is disengaged from the frame.

Further, as shown in FIG. 9, the main body cover 14 is disengaged from the frame 13 as a result of being raised upward.

Next, the actions of the above-mentioned embodiment will be described.

In the main body apparatus 10, the stays 41, which support the liquid accommodation bodies 30, are fixed to the frame 13 rather than the frame cover. Therefore, when the frame cover is disengaged from the frame 13, it is possible to disengage the frame cover in a manner in which the liquid accommodation body 30 that are supported by the stays 41, the stays 41, the ink supply tubes 47, the covers 52, and the like that are attached to the outer surface of the frame 13, are still in a state of being fixed to the frame 13. Therefore, when the frame cover is disengaged from the frame 13, circumstances in which the weight thereof is excessive, or in which a load is applied to the ink supply tubes 47, are suppressed, and therefore, it is possible to easily disengage the frame cover.

In addition, the bottomed box-shaped bottom portions 51, which cover the lower portions of the liquid accommodation bodies 30, are provided on both side walls of the frame 13, and the lid bodies 58, which cover the upper portions of the liquid accommodation bodies 30, are provided on the frame cover. Therefore, it is possible to protect the liquid accommodation bodies 30, which are supported by the stays 41, as a result of covering using the bottom portions 51 and the lid bodies 58.

In addition, the frame cover includes the lid bodies 58, which open and close the accommodation units 39 and 40. Therefore, when the frame cover is disengaged from the frame 13, the lid bodies 58 are also removed, and it is possible to expose the inner portions of the accommodation units 39 and 40 when performing maintenance of the frame 13. Therefore, it is possible to perform maintenance of the stays 41, the ink supply tubes 47, and the like, which are provided in the inner portions of the accommodation units 39 and 40 in conjunction with the above.

In addition, the stays 41 are fixed to the metal frame 43, which retains the guide frame 46 of the frame 13. Therefore, the stays 41 are fixed to sections having greater rigidity than the resin frame 42, and even in a case of heavy liquid accommodation bodies 30 that accommodate large amounts of liquid, the liquid accommodation bodies 30 are supported by the stays 41.

Additionally, even in a state in which the frame cover is attached to the frame 13, it is possible to expose both side walls of the frame 13 by opening the lid bodies 58 and disengaging the covers 52, which are provided on the inner portions of the accommodation units 39 and 40. In such a state, it is possible to check the frame 13 through the communication holes 62 that are provided in both side walls of the frame 13, to access the parts that are provided in the frame 13, and the like.

According to the abovementioned embodiment, it is possible to obtain the following effects.

(1) The stays 41, which support the liquid accommodation bodies 30, are fixed to the frame 13. Therefore, when the frame cover is disengaged from the frame 13, it is possible to disengage the frame cover in a manner in which the liquid accommodation body 30 that are supported by the stays 41, the stays 41, the ink supply tubes 47, the covers 52, and the like that are attached to the outer surface of the frame 13, are still in a state of being fixed to the frame 13. Therefore, when the frame cover is disengaged from the frame 13, circumstances in which the weight thereof is excessive, or in which a load is applied to the liquid supply tube, are suppressed, and therefore, it is possible to easily disengage the frame cover. Accordingly, it is possible to easily perform maintenance of the frame 13.

(2) The bottomed box-shaped bottom portions 51, which cover the lower portions of the liquid accommodation bodies 30, are provided on both side walls of the frame 13, and the lid bodies 58, which cover the upper portions of the liquid accommodation bodies 30, are provided on the frame cover. Therefore, it is possible to protect the liquid accommodation bodies 30, which are supported by the stays 41, as a result of covering using the bottom portions 51 and the lid bodies 58.

(3) The frame cover includes the lid bodies 58, which open and close the accommodation units 39 and 40. Therefore, when the frame cover is disengaged from the frame 13, the lid bodies 58 are also removed, and it is possible to expose the inner portions of the accommodation units 39 and 40 when performing maintenance of the frame 13. Therefore, it is possible to perform maintenance of the stays 41, the ink supply tubes 47, and the like, which are provided in the inner portions of the accommodation units 39 and 40 in conjunction with the above. Accordingly, it is possible to more easily perform maintenance of the recording apparatus.

(4) The stays 41 are fixed to the metal frame 43, which retains the guide frame 46 of the frame 13. Therefore, the stays 41 are fixed to sections having greater rigidity than the resin frame 42, and even in a case of heavy liquid accommodation bodies 30 that accommodate large amounts of liquid, it is possible to support the liquid accommodation bodies 30 using the stays 41.

(Second Embodiment)

Figure 10:
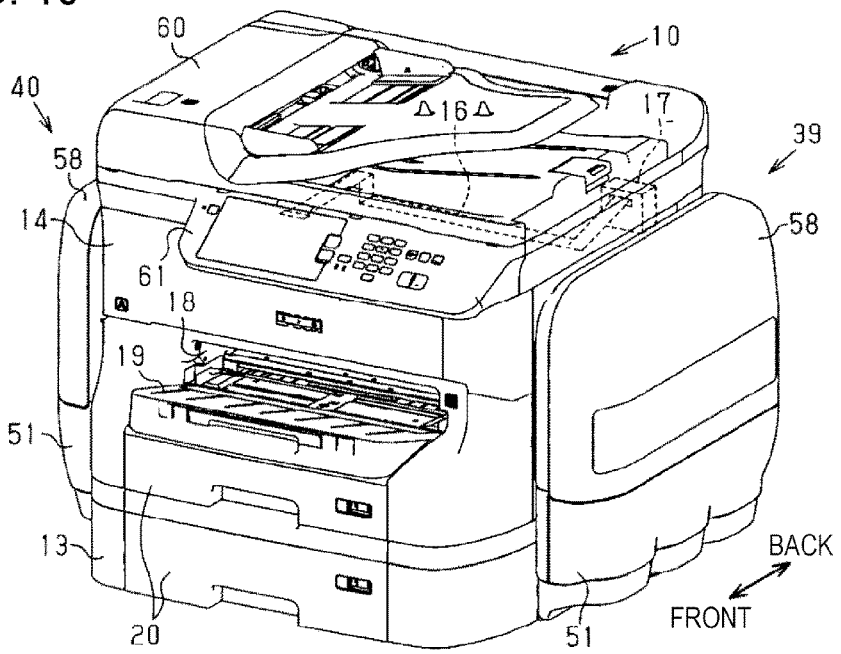
FIG. 10 is a perspective view that shows a recording apparatus as a second embodiment.

Next, a second embodiment of a recording apparatus will be described with reference to FIGS. 10 to 12. Additionally, in the recording apparatus of the present embodiment, as shown in FIG. 10, a feature of a scanner portion 60 being attached to the upper portion of the main body cover 14, is different from the first embodiment. Common reference symbols are given to the same configurations as those of the first embodiment, and detailed description thereof will be omitted.

The scanner portion 60 has a function of reading images that are recorded on a document that is set in a predetermined reading position. In addition, an operation panel 61 for a user to operate the printer, is provided in the scanner portion 60. One end of a flexible flat cable 16 is connected to the operation panel 61. The flexible flat cable 16 passes through the inner portion of the scanner portion 60, and in the same manner as the first embodiment, the other end thereof is connected to a control circuit board 17, which is provided in a frame 13, through a penetration hole 59 that is provided in a top plate 54 of a main body cover 14. Additionally, in the same manner as the above-mentioned first embodiment, a frame cover is also configured by the main body cover 14 and lid bodies 58 in the present embodiment.

In such a printer, the frame cover is disengaged from the frame 13 in the following manner.

Figure 11:
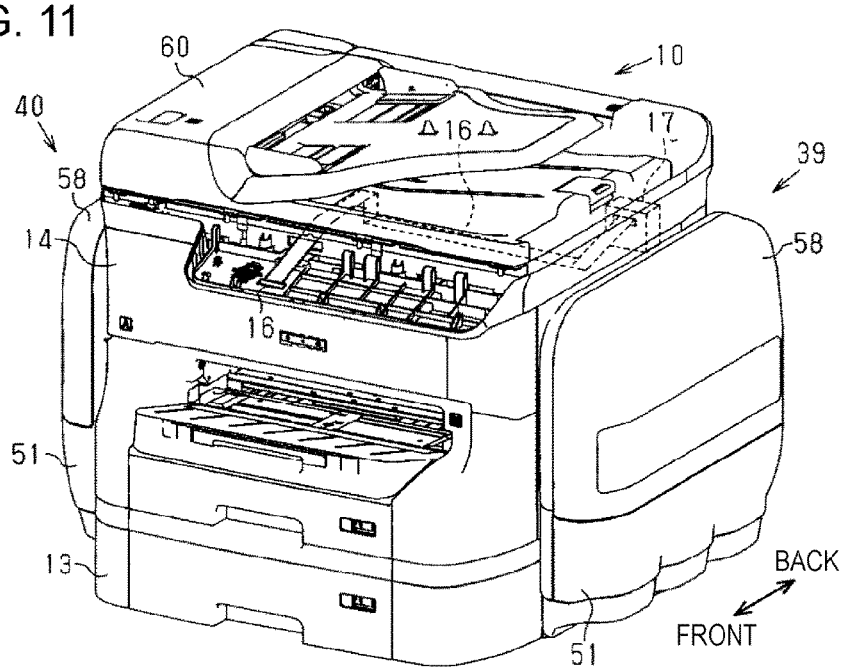
FIG. 11 is a perspective view that shows the recording apparatus in which an operation panel is disengaged.

As shown in FIG. 11, firstly, the operation panel 61 of the scanner portion 60 is disengaged, and the flexible flat cable 16 is unfastened from the operation panel 61.

Figure 12:
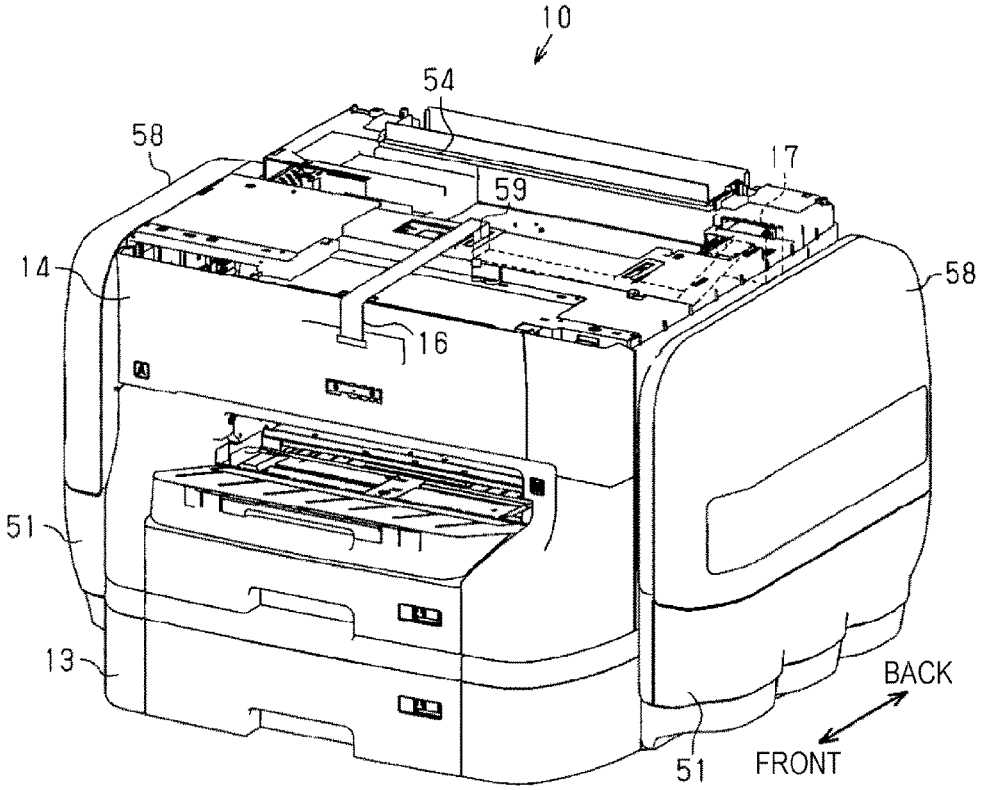
FIG. 12 is a perspective view that shows the recording apparatus in which a scanner portion is disengaged.

Next, as shown in FIG. 12, the scanner portion 60 is disengaged from the main body cover 14. Additionally, this state is the same as the state in which the operation panel 15 is disengaged from the main body cover 14 in the first embodiment. Therefore, in this state, as shown in FIG. 9, it is possible to disengage the frame cover from the frame 13 by raising the main body cover 14 upward.

In the second embodiment, stays 41, which support liquid accommodation bodies 30, are fixed to the frame 13 rather than the frame cover in the main body apparatus 10. Therefore, when the frame cover is disengaged from the frame 13, it is possible to disengage the frame cover in a manner in which the stays 41, the liquid accommodation bodies 30 that are supported by the stays 41, the ink supply tubes 47, the covers 52, and the like, are still in a state of being fixed to the frame 13. Accordingly, it is possible to obtain the above-mentioned effects (1) to (4).

(Third Embodiment)

Next, a third embodiment of a recording apparatus will be described with reference to FIG. 13. Additionally, common reference symbols are given to the same configurations as those of each of the above-mentioned embodiments, and detailed description thereof will be omitted.

Figure 13:
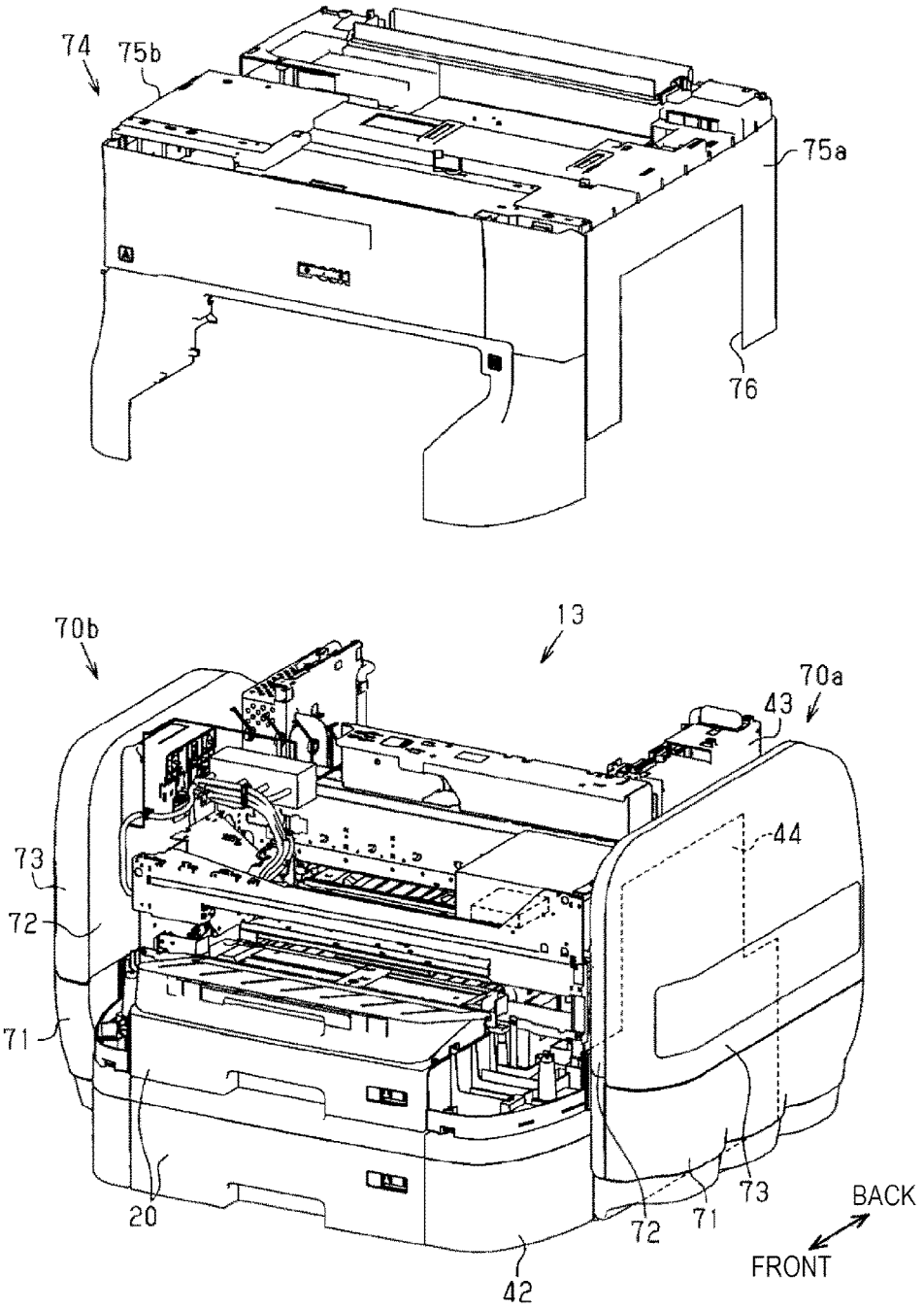
FIG. 13 is a perspective view that shows a state in which a frame cover is disengaged from a frame in a recording apparatus as a third embodiment.

As shown in FIG. 13, accommodation cases 70*a* and 70*b* are fixed to a frame 13. Each accommodation case 70*a* and 70*b* is configured by a bottomed box-shaped bottom portion 71, which forms the bottoms of the accommodation cases 70*a* and 70*b*, a side wall formation portion 72, which is connected to an upper end of a side wall of the bottom portion 71 that faces a frame 13, and a lid body 73 that is connected to an upper end of the bottom portion 71 in a revolving manner using a hinge. The lid bodies 73 are capable of abutting against and being separated from the upper ends of the side wall formation portions 72. Additionally, the side wall formation portions 72 of the accommodation cases 70*a* and 70*b* are fixed to both side walls 44 and 45 of a metal frame 43 of the frame 13. That is, the accommodation cases 70*a* and 70*b* are provided separately from a main body cover 74 rather than being fixed to the main body cover 74. The stays 41 are fixed to the side wall formation portions 72 on the inner surfaces of the accommodation cases 70*a* and 70*b*. Therefore, the stays 41 are accommodated in the accommodation cases 70*a* and 70*b* as a result of being fixed to both side walls of the frame 13 via the side wall formation portions 72. That is, a support unit, which supports liquid accommodation bodies 30, is configured by the stays 41, the side wall formation portions 72 and both side walls of the frame 13.

In addition, holes are provided in the side wall formation portions 72 of the accommodation cases 70*a* and 70*b* in positions that correspond to communication holes 62, which are provided in a metal frame 43, and the holes are blocked by covers 52, which are provided in the inner portions of the accommodation cases 70*a* and 70*b*.

The main body cover 74 has a box-shape in which the lower end is open, and notched portions 76, which are cut out from a lower end to fit the shapes of both side walls 44 and 45 of the metal frame 43, are provided in both side walls 75*a* and 75*b* in the left-right direction. Further, a main body apparatus 10 is configured as a result of the main body cover 74 being attached to the frame 13 from above. That is, the main body cover 74 functions as a frame cover.

Next, the actions of the present embodiment will be described.

The stays 41, which support the liquid accommodation bodies 30, are accommodated in the accommodation cases 70*a* and 70*b*, and the accommodation cases 70*a* and 70*b* are fixed to the frame 13 via the side wall formation portions 72. Therefore, as shown in FIG. 13, when the main body cover 74 is disengaged from the frame 13 as a result of being raised upward, it is possible to disengage the main body cover 74 in a manner in which the accommodation cases 70*a* and 70*b*, which accommodate the stays 41, are still in a state of being fixed to the frame 13. Therefore, when the main body cover 74 is disengaged from the frame 13, circumstances in which the weight thereof is excessive, or in which a load is applied to the ink supply tubes 47, are suppressed, and therefore, it is possible to easily disengage the main body cover 74.

In addition, since the stays 41 are accommodated in the accommodation cases 70*a* and 70b, the liquid accommodation bodies 30, which are supported by the stays 41, are protected by the accommodation cases 70*a* and 70*b*.

The side wall formation portions 72, to which the stays 41 are fixed, of the accommodation cases 70*a* and 70*b*, are fixed to the metal frame 43, which retains the guide frame 46 of the frame 13. Therefore, the stays 41 are fixed to sections having greater rigidity than the resin frame 42.

Additionally, even in a state in which the main body cover 74 is attached to the frame 13, it is possible to expose both side walls of the frame 13 from the holes of the side wall formation portions 72 by opening the accommodation cases 70*a* and 70*b* and disengaging the covers 52. In such a state, it is possible to check the frame 13 through the communication holes 62 that are provided in both side walls of the frame 13, to access the parts that are provided in the frame 13, and the like.

According to the abovementioned embodiment, it is possible to obtain the following effects.

(1) Since the stays 41, which support the liquid accommodation bodies 30, are fixed to the frame 13, when the frame cover is disengaged from the frame 13, it is possible to disengage the frame cover in a manner in which the accommodation cases 70*a* and 70*b* are still in states of being fixed to the frame 13. Therefore, when the frame cover is disengaged from the frame 13, a circumstance in which the weight thereof is excessive is suppressed, and therefore, it is possible to easily disengage the frame cover. Accordingly, it is possible to easily perform maintenance of the frame 13.

(2) Since the stays 41 are accommodated in the accommodation cases 70*a* and 70*b*, it is possible to protect the liquid accommodation bodies 30, which are supported by the stays 41, using the accommodation cases 70*a* and 70*b*.

(3) The stays 41 are fixed to the metal frame 43, which retains the guide frame 46 of the frame 13. Therefore, the stays 41 are fixed to sections having greater rigidity than the resin frame 42, and even in a case of heavy liquid accommodation bodies 30 that accommodate large amounts of liquid, it is possible to support the liquid accommodation bodies 30 using the stays 41.

Additionally, the abovementioned embodiments may be changed in the following manner.

The lid bodies 58 and the bottom portions 51 may be provided in the frame cover.

Figure 14:
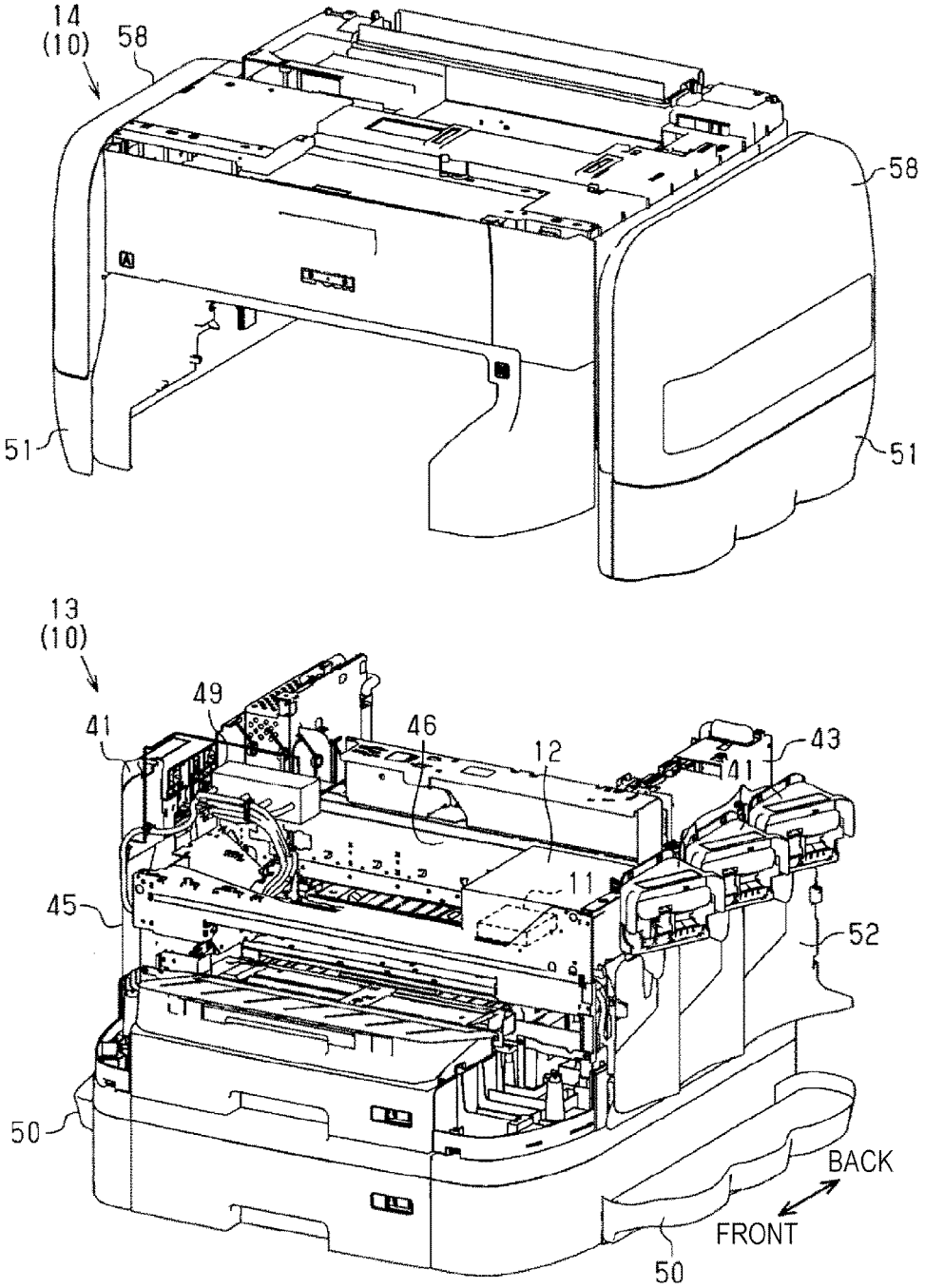
FIG. 14 is a perspective view that shows a state in which a frame cover is disengaged from a frame in a recording apparatus as another embodiment.

As shown in FIG. 14, the main body cover 14 has a box-shape in which the lower end is open, and notched portions, which are cut out from a lower end to fit the shapes of both side walls of the frame 13, are provided in both side walls in the left-right direction. Further, the lid bodies 58 are connected to the upper ends of both side walls in a revolving manner. The bottom portions 51, the lower ends of which are open, are connected to the lower ends of the lid bodies 58.

According to such a configuration, as shown in FIG. 14, it is possible to disengage the lid bodies 58 and the bottom portions 51, which are provided in the frame cover, in an integral manner by raising the main body cover 14 upward from the frame 13, and therefore, it is possible to expose the inner portion of an accommodation unit.

In the first embodiment and the second embodiment, a recording apparatus in which the recording head 11, which is supported by the carriage 12, moves along the guide frame 46, is described as an example, but the recording head 11 need not necessarily move. That is, if a recording head that is longer than the sheets of paper in a direction that is orthogonal to a paper feeding direction is provided, and a carriage that supports the recording head is fixed to a guide frame, it is possible to perform recording by ejecting the ink onto the sheets of paper without moving the recording head.

The attachment positions of the stays 41 can be altered as appropriate. For example, the stays 41 may be fixed to sections of the metal frame 43 that support the control circuit board 17, or the stays 41 may be fixed to sections of the frame 13 that are formed by the resin frame 42. In addition, the stays 41 may be altered in the following manner.

That is, the carriage 12, which moves the recording head 11, the guide frame 46, which supports the carriage 12, the metal frame 43, to which the guide frame 46 is fixed, and a sheet metal member which configures the frame 13 as a result of being provided separated from the metal frame 43, may be provided in the frame 13. Further, the stays 41 may be fixed to the sheet metal member.

If the stays 41 are fixed to the metal frame 43, to which the guide frame 46 is fixed, there is a concern that distortion will occur in the metal frame 43 as a result of the weight of the liquid accommodation bodies 30, which are supported by the stays 41. If distortion occurs in the metal frame 43, there is a concern that the guide frame 46, which is fixed to the metal frame 43 will become distorted, and that it will no longer be possible to control the movement of the carriage 12, which moves along the guide frame 46, with high accuracy.

According to the above-mentioned configuration, since the stays 41, which support the liquid accommodation bodies 30, are fixed to the sheet metal member, which is provided separated from the metal frame 43 to which the guide frame 46 is fixed, even if the sheet metal member becomes distorted due to the weight of the liquid accommodation bodies 30, which are supported by the stays 41, it is difficult for distortion to occur in the metal frame 43, to which the guide frame 46 is fixed. As a result of this, it is possible to prevent distortion of the guide frame 46 by suppressing the occurrence of distortion in the metal frame 43. In addition, since, in the frame 13, the stays 41 are fixed to the sheet metal member, the rigidity of which is greater than that of the resin frame 42, even in a case of heavy liquid accommodation bodies 30 that accommodate large amounts of liquid, it is possible to support the liquid accommodation bodies 30 using the stays 41.

The frame 13 may be configured from a resin frame only. In such a case, a separate sheet metal member may be provided, and the stays 41 and the side wall formation portions 72 may be fixed to both side walls of the frame 13 using the sheet metal member.

Figure 15:
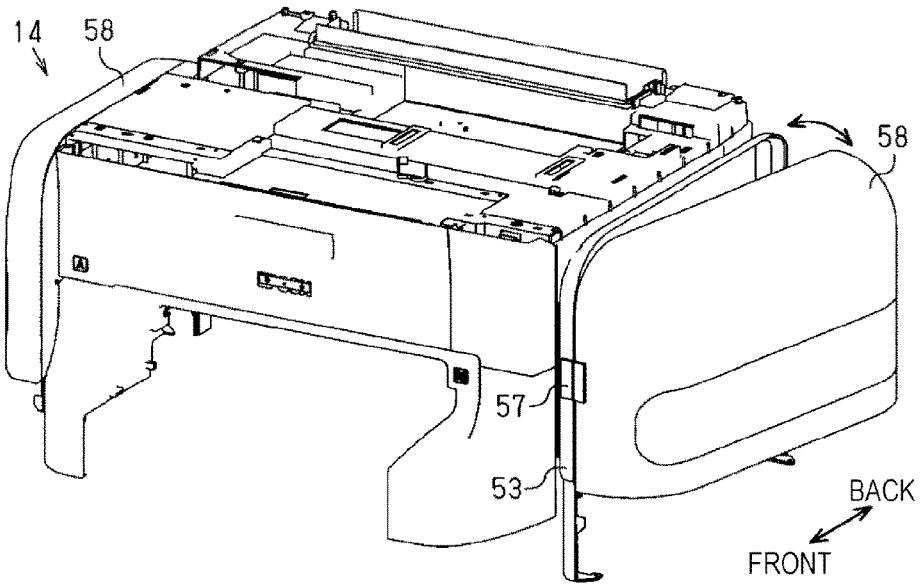
FIG. 15 is a perspective view that shows another configuration of a lid body that is provided on a frame cover.

In the first embodiment and the second embodiment, the opening directions of the lid bodies 58 may be altered. That is, as shown in FIG. 15, the lid bodies 58 are connected to the support columns 53 of the main body cover 14 using the hinges 57. According to such a configuration, it is possible to revolve the lid bodies 58 with one end, to which the hinges 57 are connected, as an axis, and open the other end side, to which the hinges 57 are not connected.

Figure 16:
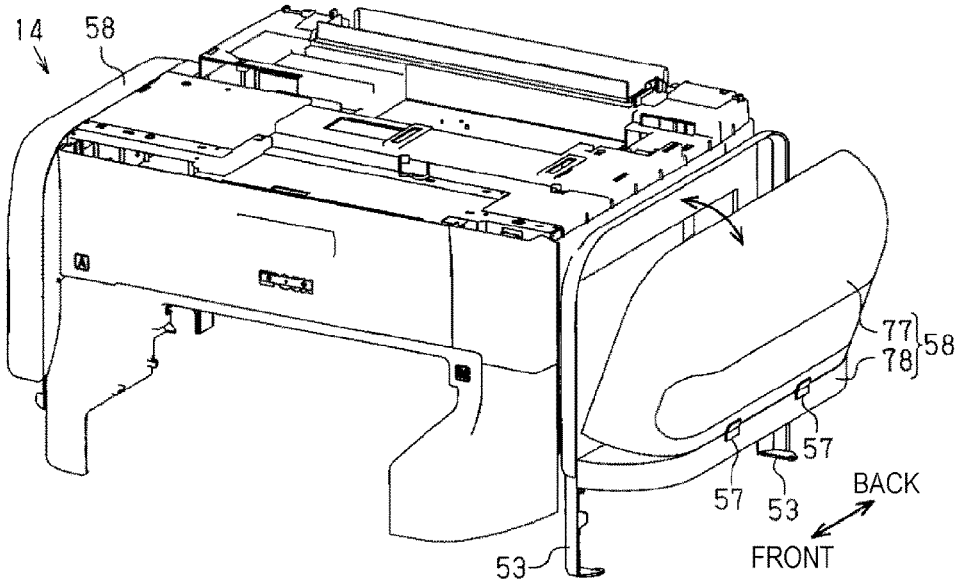
FIG. 16 is a perspective view that shows another configuration of a lid body that is provided on a frame cover.

In addition, as shown in FIG. 16, the lid bodies 58 are divided top and bottom into upper lid portion 77 and lower lid portions 78, and the upper lid portions 77 and lower lid portions 78 are connected using hinges 57. Further, the lower lid portions 78 are fixed to the support columns 53. According to such a configuration, it is possible to open upper end sides by revolving the upper lid portions 77 of the lid bodies 58 with the lower ends thereof as axes.

When the frame cover is attached to the frame 13, it is not necessary for the lid bodies 58 and the bottom portions 51 to come into contact with one another. That is, when the frame cover is attached to the frame 13, a gap may be provided between the lid bodies 58 and the bottom portions 51.

In the first embodiment and the second embodiment, the lid bodies 58 need not necessarily be provided in the frame cover. In addition, the bottom portions 51 need not necessarily be provided in the frame 13. Even in such a configuration, as long as the stays 41 are fixed to the frame 13 of the main body apparatus 10, it is possible to disengage the frame cover in a manner in which the stays 41 and the liquid accommodation bodies 30 are still fixed to the frame 13. Additionally, in such a configuration, the stays 41 and the liquid accommodation bodies 30, which are supported by the stays 41, are provided in an outer portion of the main body apparatus 10 in a bare state.

In the third embodiment, only the side wall formation portions 72 may be provided instead of providing the bottom portions 71 and the lid bodies 73 of the accommodation cases 70*a* and 70*b*. Even in such a case, it is possible to fix the stays 41 to the frame 13 by fixing the stays 41 to the side wall formation portions 72, which are fixed to the frame 13. Additionally, in such a configuration, the stays 41 and the liquid accommodation bodies 30, which are supported by the stays 41, are provided in an outer portion of the main body apparatus 10 in a bare state.

In the third embodiment, the sections of the accommodation cases 70*a* and 70*b* to which the side wall formation portions 72 are fixed may be the resin frame 42 of the frame 13.

In the third embodiment, the holes need not necessarily be provided in the side wall formation portions 72.

The cover 52 need not necessarily be provided.

The communication holes 62 need not necessarily be provided in the metal frame 43.

The main body cover 14 may be divided, and, for example, the main body cover 14 may be configured from a left side member and a right side member. According to such a configuration, by disengaging the right side member, which covers the control circuit board 17, only, it is possible to perform maintenance of the control circuit board 17 without disengaging the entire frame cover. Additionally, the direction of the division is not limited to the left-right direction, and division may be performed in the front-back direction, of division may be performed in two or more directions.

Liquid accommodation bodies 30 in which the ink is accommodated in the ink bags 31, which are formed from a flexible material, are described as an example, but the configuration of the liquid accommodation bodies 30 is not limited to such a configuration. For example, a liquid accommodation body may accommodate the ink in a box that is formed by a resin.

Three stays 41 are accommodated in the first accommodation unit 39, and a single stay 41 is accommodated in the second accommodation unit 40, but the number of these may be altered as appropriate. In addition, only one of the first accommodation unit 39 and the second accommodation unit 40 may be provided.

REFERENCE SIGNS LIST

10 MAIN BODY APPARATUS
11 RECORDING HEAD
12 CARRIAGE
13 FRAME
14 MAIN BODY COVER
15 OPERATION PANEL
16 FLEXIBLE FLAT CABLE
17 CONTROL CIRCUIT BOARD
18 DISCHARGE APERTURE
19 DISCHARGE TRAY
20 PAPER SUPPLY CASSETTE
30 LIQUID ACCOMMODATION BODY
31 INK BAG
32 HANDLE PORTION
33 IC CHIP
39 FIRST ACCOMMODATION UNIT
40 SECOND ACCOMMODATION UNIT
41 STAY
42 RESIN FRAME
43 METAL FRAME
44 RIGHT SIDE WALL
45 LEFT SIDE WALL
46 GUIDE FRAME
47 INK SUPPLY TUBE
48 TUBE THROUGH HOLE
49 RELAY
50 RECEPTION PORTION
51 BOTTOM PORTION
52 COVER
53 SUPPORT COLUMN
54 TOP PLATE
55 FLANGE PORTION
56 SCREW HOLE
57 HINGE
58 LID BODY
59 PENETRATION HOLE
60 SCANNER PORTION
61 OPERATION PANEL
62 COMMUNICATION HOLE
70*a* and 70*b* ACCOMMODATION CASE
71 BOTTOM SECTION
72 SIDE WALL FORMATION PORTION
73 LID BODY
74 MAIN BODY COVER
75*a* and 75*b* SIDE WALL
76 NOTCHED PORTION
77 UPPER LID PORTION
78 LOWER LID PORTION

The invention claimed is:

1. A recording apparatus comprising:

a frame;

a recording portion that is disposed in the frame, and that includes a recording head, which ejects a liquid onto a recording medium, and a carriage, in which the recording head is mounted, and which reciprocates;

a support unit that is fixed to the frame, and supports a liquid accommodation body which accommodates a liquid to be ejected from the recording portion by having at least a portion of the liquid accommodation body be inserted into the support unit, wherein the support unit supports the liquid accommodation body outside the frame;

a liquid supply tube that supplies a liquid that is accommodated in the liquid accommodation body, which is supported by the support unit, to the recording portion; and a frame cover that is detachable from the frame;

wherein the frame includes a guide frame, which guides the carriage, and a retention frame, which retains end portions of the guide frame in a direction in which the carriage reciprocates, and wherein the support unit is fixed to the retention frame such that when the frame cover is detached, the support unit remains fixed to the retention frame.

2. The recording apparatus according to claim 1, wherein the frame cover covers the liquid accommodation body, which is supported by the support unit.

3. The recording apparatus according to claim 2, wherein the frame cover is provided with a lid body that opens and closes an opening, through which the liquid accommodation body is retrieved.

4. The recording apparatus according to claim 1, wherein the support unit includes a support unit cover, which covers a lower portion of the liquid accommodation body, which is supported by the support unit, and wherein the frame cover covers an upper portion of the liquid accommodation body, which is supported by the support unit.

5. The recording apparatus according to claim 4, wherein the frame cover is provided with a lid body that opens and closes an opening, through which the liquid accommodation body is retrieved.

6. The recording apparatus according to claim 1, wherein the support unit includes an accommodation case, which accommodates the liquid accommodation body, which is supported by the support unit, and wherein the frame cover is separate from the accommodation case.

7. The recording apparatus according to claim 1, wherein the support unit includes a partitioning wall, which partitions the liquid accommodation body, which is supported by the support unit, and the frame, and wherein the partitioning wall includes a communication hole, which exposes the frame.

8. A recording apparatus comprising:

a frame;

a recording portion that is disposed in the frame, and performs recording by ejecting a liquid onto a recording medium;

a support unit that is disposed in the frame, and supports a liquid accommodation body, which accommodates a liquid to be ejected from the recording portion, outside the frame;

a liquid supply tube that supplies a liquid that is accommodated in the liquid accommodation body, which is supported by the support unit, to the recording portion; and a frame cover that is detachable from the frame; and a lid cover that is connected in revolving manner to the frame cover, the lid cover being revolvable to cover and uncover the liquid accommodation body when the frame cover is attached to the frame.

9. A recording apparatus comprising:

a frame;

a recording portion that is disposed in the frame, and performs recording by ejecting a liquid onto a recording medium;

a support unit that is fixed to the frame, and supports a liquid accommodation body, which accommodates a liquid to be ejected from the recording portion, outside the frame;

a liquid supply tube that supplies a liquid that is accommodated in the liquid accommodation body, which is supported by the support unit, to the recording portion; and a frame cover that is detachable from the frame;

wherein, when the frame cover is detached, the support unit remains disposed in the frame.

10. The recording apparatus according to claim 9, wherein at least a portion of the liquid accommodation body is inserted into the support unit.

* * * * *